United States Patent [19]

Kaczur et al.

[11] 4,308,125

[45] Dec. 29, 1981

[54] CONDUCTOR ASSEMBLY FOR ELECTROLYTIC CELLS

[75] Inventors: Jerry J. Kaczur; Sudhir K. Mendiratta, both of Cleveland, Tenn.

[73] Assignee: Olin Corporation, New Haven, Conn.

[21] Appl. No.: 113,921

[22] Filed: Jan. 21, 1980

[51] Int. Cl.[3] ..... C25B 9/04

[52] U.S. Cl. ..... 204/279; 204/274; 204/275

[58] Field of Search ..... 174/24, 15 C; 204/279, 204/274, 280, 275

[56] References Cited

U.S. PATENT DOCUMENTS

| | | | |
|---|---|---|---|
| 3,511,766 | 5/1970 | Kisner et al. | 204/279 |
| 3,674,912 | 7/1972 | Titus et al. | 174/15 C |
| 3,838,384 | 9/1974 | Jacobs | 204/279 |
| 4,013,538 | 3/1977 | Schneider et al. | 204/280 |
| 4,194,960 | 3/1980 | Bleikamp, Jr. | 204/280 |

*Primary Examiner*—Donald R. Valentine
*Attorney, Agent, or Firm*—James B. Haglind; Donald F. Clements

[57] ABSTRACT

A current conductor assembly for conducting electric current to electrodes in cells for the electrolysis of a salt solution is comprised of a conductor and a nonconductive casing for the conductor. There is a space between the conductor and the casing with an inlet in the casing for receiving a fluid. The conductor assembly has means for supplying a pressurized fluid to the space between the conductor and the casing; means for sealingly attaching one end of the conductor assembly to the electrodes, where this end is immersed in the salt solution; and a compressible sealing assembly for the opposite end of the conductor assembly comprised of a compression means and a sealing means.

The conductor assembly employs the pressurized fluid to prevent corrosive attack of the conductor metal should a leak develop in the conductor assembly.

4 Claims, 4 Drawing Figures

CONDUCTOR ASSEMBLY FOR ELECTROLYTIC CELLS

This invention relates generally to electrolytic cells and particularly to conductors for supplying electric current to electrolytic cells.

Electrolytic cells for the electrolysis of salt solutions include those used in the production of chlorine and alkali metal hydroxides, alkali metal chlorates, or oxygen and hydrogen which require current conductor assemblies which can be immersed in the corrosive electrolytes employed without damage to the metal employed as the conductor. FIG. 2 shows a vertical conductor assembly which is employed with cells for the production of alkali metal chlorates by the electrolysis of alkali metal chlorides. The conductor assembly includes a conductive metal bar or rod, usually copper, surrounded by a nonconductive casing. One end of the conductor assembly is immersed in the electrolytic solution and is sealingly attached to the electrodes. The other end of the conductor assembly, as shown in FIG. 2, includes a washer placed on the top of the casing with a spring placed between the washer and a nut to exert a downward force on the casing. A liquid fills the space between the casing and conductor bar to cool the conductor. An earlier version used a rubber cylinder above the washer in place of the spring, but this was found to be difficult to install and remove and was not fluid-tight. While the upper portion of the conductor assembly as shown in FIG. 2 was suitable for cooling the conductor rod, it was difficult to detect when a leak had occurred at the connection of the conductor rod to the electrodes and substantial corrosive damage to the conductor metal by the electrolyte solutions took place before a leak was detected. In addition, it was desirable to provide a conductor assembly which could employ a pressurized fluid to prevent corrosive attack of the conductor metal by the electrolyte solutions should a leak develop.

It is an object of the present invention to provide a conductor assembly which would prevent corrosive attack on the conductor by the salt solution should a leak develop in the conductor assembly.

Another object of the present invention is to provide a conductor assembly in which a pressurized fluid is employed.

These and other objects of the invention are accomplished by a current conductor assembly for conducting electric current to electrodes in cells for the electrolysis of a salt solution which comprises a conductor, a nonconductive casing for the conductor, a space between the conductor and the casing, an inlet in said casing for receiving a fluid noncorrosive to the conductor, means for supplying the fluid under pressure to the space between the conductor and the casing, means for sealing one end of the conductor assembly to the electrodes, this end being immersed in the salt solution, and a compressible sealing assembly for the opposite end of the conductor assembly comprised of a compression means and a sealing means.

The invention will be better understood by reference to the attached drawings which show two embodiments of the invention by way of example and in which.

Figure 3:
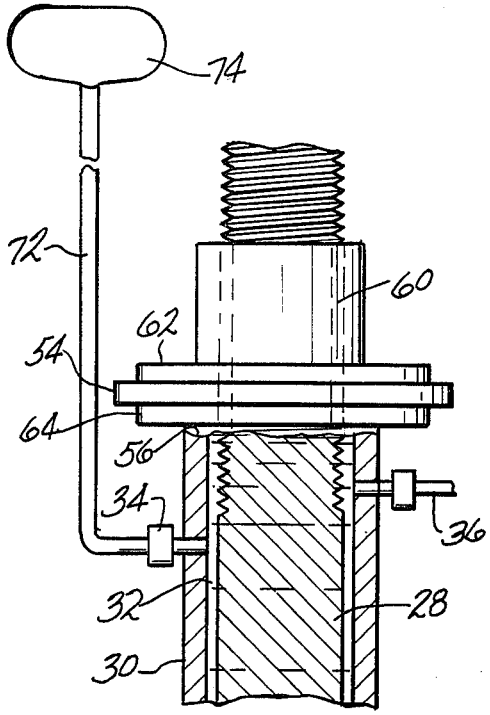
FIG. 3 is a partially sectioned upper portion of a vertical conductor assembly of the present invention.
Figure 1:
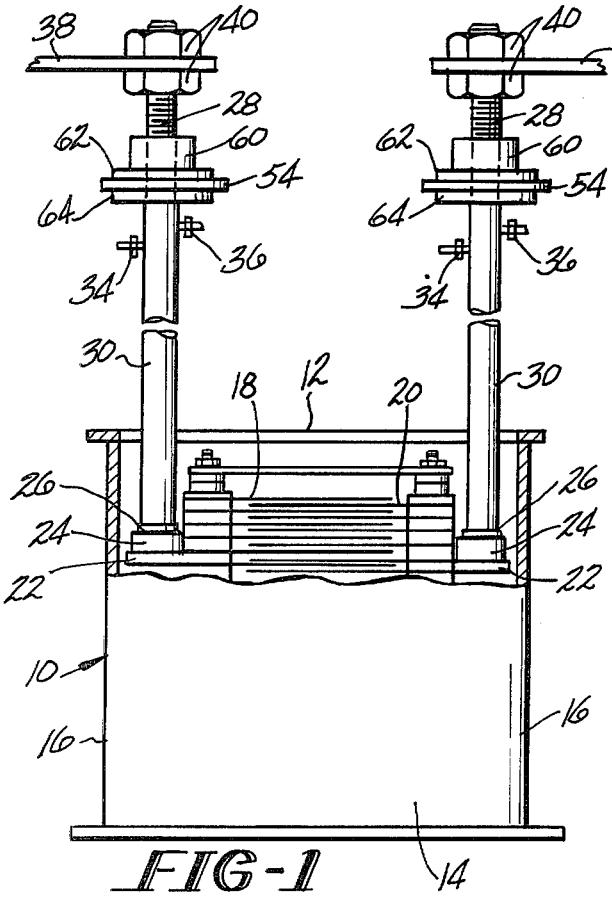
FIG. 1 is a side elevation of an electrolytic cell chamber with the chamber wall partially broken away.

Referring to FIGS. 1 and 3, an electrolytic cell chamber 10 is shown having a cover 12 and walls 14, side walls 16 and a bottom (not shown). Within electrolytic cell chamber 10, a plurality of foraminous metal anodes 18 are positioned horizontally in a substantially parallel spaced face to face relation to a plurality of foraminous metal cathodes 20. Conductor bases 22 are comprised of internally threaded bosses 24 and gaskets 26. Conductor rods 28 are threadedly connected to bosses 24. Electrically nonconducting casings 30 surround conductor rods 28 and are separated by spaces 32. Inlet 34 and outlet 36 permit the introduction into and removal of a fluid coolant from space 32. Electric current is supplied to conductor rods 28 by bus bars 38 secured by nuts 40.

Figure 2:
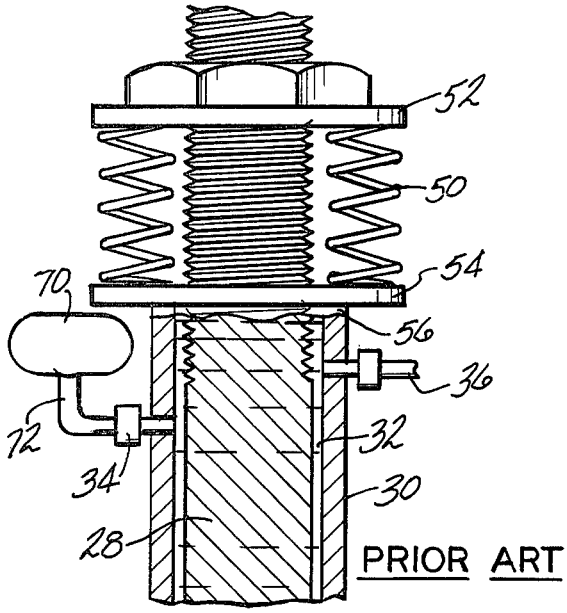
FIG. 2 is a partially sectioned upper portion of a vertical conductor assembly of the prior art.

In the upper portion of the conductor assembly of the prior art, as shown in FIG. 2, springs 50 are held between nut 52 attached to externally threaded portions of conductor 28 and washer 54 and press washer 54 against top edge 56 of casing 30 with sufficient pressure to maintain a liquid-tight seal between the bottom edge of casing 30 and gasket 26 (see FIG. 1). A liquid is fed from reservoir 70 through pipe 72 and inlet 34 to space 32. The liquid level can only be essentially up to outlet 36 since at higher levels the liquid passes through washer 54.

FIG. 3 illustrates one embodiment of the upper portion of the conductor assembly of the present invention wherein internally threaded collar 60 is attached to an externally threaded portion of conductor rod 28 to compress gasket 62 against washer 54. Washer 54 in turn compresses gasket 64 against top edge 56 of casing 30 to form a compressible liquid-tight seal. Fluid is fed under pressure from tank 74 through pipe 72 and inlet 34 to space 32 between conductor rod 28 and casing 30.

Outlet 36 can be open to permit flow of the fluid under pressure as it can be closed to permit the fluid to remain in space 32 and serve as a heat transfer medium. When outlet 36 is closed, the lowering of fluid in tank 74 serves as a means of detecting a leak in the conductor assembly.

Figure 4:
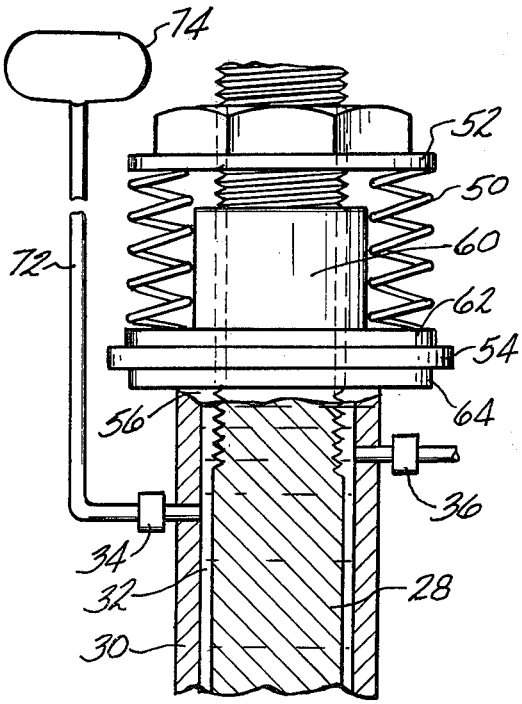
FIG. 4 is a partially sectioned upper portion of another embodiment of a vertical conductor assembly of the present invention.

In FIG. 4, springs 50, held between nut 50 and gasket 62, serve as an auxiliary compression means to that of collar 60.

In the conductor assembly of the present invention, the compression means used in the compressible sealing assembly for the end of the conductor assembly outside of the cell chamber may be of any type which will suitably compress the sealing means against the top of the casing to form a liquid-tight seal. For example, collar 60 may have a flange along one edge in which case it may be possible to omit gasket 62 and washer 54 and have the flange of the collar in contact with gasket 64. The compression means may be of any suitable material of construction including plastics, metals, or a combination of plastics and metals. Preferably, the material of construction is one having a coefficient of expansion which is similar to that of the conductor rods which are usually copper or aluminum. Suitable metals include copper, brass and titanium. Preferred as materials of construction for the compression means are plastics such as polyethylene, polypropylene, polyvinyl chloride, and polytetrafluoroethylene.

Between internally threaded collar 60 and the externally threaded conductor rod 28, it may be desirable to use a plastic thread dope to assure a liquid-tight joint.

Suitable sealing means include, for example, gaskets composed of resilient materials such as silicone rubber, fluoroelastomers such as Vitron® (E. I. duPont de Nemours & Co.) and which may be compressed by the compression means to form a fluid-tight seal.

As a coolant for the conductor rods, any fluid may be used which is noncorrosive to components of the conductor assembly and compatible with solutions and gases produced in the electrolytic cell. Suitable examples include liquids such as water, carbon tetrachloride and fluorinated hydrocarbons or fluorinated ethers; and gases such as nitrogen, helium, or oxygen; with water being a preferred coolant. Fluid coolant circulated under pressure through space 32 in the conductor assembly may be recovered through outlet 36 and cooled, if necessary, and returned by known methods to tank 74. For adequate cooling, the inlet and outlet may be positioned at any suitable place along the casing.

The novel current conductor assembly of the present invention enables the fluid coolant to be maintained at a pressure sufficient to prevent electrolyte solutions in the cell from corrosively attacking the conductor rods should a leak develop in the portion of the conductor assembly within the cell. Should a leak develop, the pressure forces the fluid coolant into the electrolyte solution and prevents the entry of the electrolyte into the conductor assembly. In addition, the reduction in fluid pressure or the liquid level in tank 74 provides operating personnel with an indication that a leak is present and permits them to take appropriate protective measures. Suitable fluid pressures used include those equivalent to pressures obtained with a reservoir providing a head level of from about 0.5 to about 6, and preferably from about 1 to about 4 feet where water is the fluid coolant.

The novel conductor assembly of the present invention may be employed with cells for the electrolysis of salt solutions such as alkali metal chlorides used in the production of chlorine and alkali metal hydroxides or alkali metal chlorates or basic aqueous solutions used in the production of oxygen and hydrogen. A preferred group of cells on which the conductor assembly of the present invention may be employed are electrolytic cells employing vertical conductor assemblies used in the production of alkali metal chlorates. Suitable examples are the cells described in U.S. Pat. No 2. 3,791,947, issued Feb. 12, 1974, to R. E. Loftfield; 3,819,503, issued June 25, 1974, to H. V. Casson et al; 3,864,237, issued Feb. 4, 1975, to R. E. Loftfield; and 4,087,344, issued May 2, 1978, to H. V. Casson et al; the entire disclosures of these patents being incorporated by reference herein.

While FIGS. 1 and 3 show the novel conductor assembly of the present invention positioned vertically, the compressible sealing assembly permits the conductor assembly to be positioned, for example, horizontally.

What is claimed is:

1. A vertical current conductor assembly for conducting electrical current to electrodes in cells for the electrolysis of a salt solution which comprises:

(a) a conductor rod, said conductor rod having a threaded portion at its upper end, (b) a nonconductive casing for said conductor rod, (c) a space between said conductor rod and said casing, (d) an inlet in said casing adapted to receive a fluid noncorrosive to said conductor rod, (e) an outlet in said casing adapted to remove said fluid from said casing, (f) means for attaching the lower end of said conductor assembly to said electrodes, said lower end being adapted to be immersed in said salt solution, (g) a compressible sealing assembly for said threaded end of said conductor rod comprised of a collar threadingly connected to said conductor rod and a sealing means, said compressible sealing assembly providing a fluid-tight seal at the upper end of the conductor assembly, and (h) means positioned above said compressible sealing assembly and connected to said inlet adapted to supply said fluid to said space between said casing and said conductor at a pressure sufficient to prevent said salt solution from penetrating said current conductor assembly should a leak develop at the lower end of said conductor assembly.

2. The current conductor assembly of claim 1 in which said sealing means is a gasket.

3. The current conductor assembly of claim 2 in which said fluid is a liquid selected from the group consisting of water, carbon tetrachloride, fluorinated hydrocarbons, and fluorinated ethers.

4. The current conductor assembly of claim 1 in which said compression means is composed of a plastic selected from the group consisting of polyethylene, polypropylene, polyvinyl chloride, and polytetrafluoroethylene.

* * * * *